US007357739B2

(12) United States Patent
Montano et al.

(10) Patent No.: US 7,357,739 B2
(45) Date of Patent: Apr. 15, 2008

(54) LACROSSE-STICK HEADS

(75) Inventors: Benjamin Richard Montano, Millis, MA (US); Kyle Larry Lamson, Chelmsford, MA (US); Alexander Parker Reynolds, South Boston, MA (US); Jon Garfield Wong, Huntington Beach, CA (US)

(73) Assignee: Brine, Inc., Milford, MA (US)

( * ) Notice: Subject to any disclaimer, the term of this patent is extended or adjusted under 35 U.S.C. 154(b) by 528 days.

(21) Appl. No.: 10/719,644

(22) Filed: Nov. 21, 2003

(65) Prior Publication Data

US 2006/0183575 A1 Aug. 17, 2006

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513; D21/724

See application file for complete search history.

(56) References Cited

U.S. PATENT DOCUMENTS

| | | | | |
|---|---|---|---|---|
| 3,702,702 | A * | 11/1972 | Hoult | 473/513 |
| D248,679 | S | 7/1978 | Rule | D34/5 CT |
| 4,138,111 | A | 2/1979 | Rule | 273/96 D |
| D263,249 | S | 3/1982 | Rule | D21/210 |
| D265,845 | S | 8/1982 | Brine, Jr. et al. | D21/210 |
| D277,691 | S | 2/1985 | Rule | D21/210 |
| D286,666 | S | 11/1986 | Brine, Jr. | D21/210 |
| D286,803 | S | 11/1986 | Brine, Jr. | D21/210 |
| 6,066,056 | A * | 5/2000 | Morrow | 473/513 |
| 6,213,901 | B1 * | 4/2001 | Collinson | 473/513 |
| 6,506,132 | B1 | 1/2003 | Brine, III et al. | 473/513 |
| 6,916,259 | B2 * | 7/2005 | Kohler et al. | 473/513 |
| 2002/0107094 | A1 * | 8/2002 | LeMire | 473/513 |

OTHER PUBLICATIONS

Webpage downloaded Aug. 8, 2007, E-Lacrosse, 2003,http://www.e-lacrosse.com/2003/brine/interview.html,4 pages.*

Brine Catalogue; Online website: http://www.brine.com/laxwomen.php?section=products&page=index&cat=heads.

Brine Catalogue; Online website: http://www.brine.com/lacrosse.php?section=products&page=index&cat=heads.

* cited by examiner

*Primary Examiner*—Eugene Kim
*Assistant Examiner*—M. Chambers
(74) *Attorney, Agent, or Firm*—Dickinson Wright PLLC

(57) ABSTRACT

Lacrosse-stick heads are described. In one embodiment, a lacrosse-stick head includes a throat, a transverse wall, and two sidewalls extending outward from the throat and connected by the transverse wall. The throat includes two side surfaces. At least one of the sidewalls and an adjacent side surface of the throat are sized, shaped, and positioned for stably rolling a lacrosse ball throughout at least a portion of the length of the at least one of the sidewalls and onto the adjacent side surface. The portion includes more than one half of the length of the at least one of the sidewalls.

24 Claims, 7 Drawing Sheets

LACROSSE-STICK HEADS

BACKGROUND

Lacrosse is a team sport in which players can use a lacrosse stick to maneuver a lacrosse ball into a goal. A lacrosse stick can include a handle, a head disposed on the handle, and a pocket disposed on the head for receiving a lacrosse ball. A lacrosse player can use the pocket of a lacrosse stick to catch, carry, throw, and otherwise control a lacrosse ball.

SUMMARY

Lacrosse-stick heads that allow a lacrosse player to catch, carry, throw, and otherwise control a lacrosse ball using the sides of the heads are described.

In one embodiment, a lacrosse-stick head includes a throat, a transverse wall, and two sidewalls extending outward from the throat and connected by the transverse wall. The throat includes two side surfaces. At least one of the sidewalls and an adjacent side surface of the throat are sized, shaped, and positioned for stably rolling a lacrosse ball throughout at least a portion of the length of the at least one of the sidewalls and onto the adjacent side surface. The portion of the length includes more than one half of the length of the at least one of the sidewalls.

In one aspect, the at least one of the sidewalls can include upper and lower arms. The at least one of the sidewalls can include at least one connecting portion connecting the upper and lower arms. The upper and lower arms, the at least one connecting portion, and the adjacent side surface can be sized, shaped, and positioned for stably rolling a lacrosse ball along the upper and lower arms throughout the portion of the length and onto the adjacent side surface without contacting the at least one connecting portion. Alternatively and/or in combination, the upper and lower arms and the at least connecting portion can be sized, shaped, and positioned for stably rolling a lacrosse ball along the upper and lower arms along substantially the entire length of the one or more of the sidewalls without contacting the at least one connecting portion.

In one aspect, the portion of the length can include substantially the entire length of the at least one of the sidewalls.

In one aspect, for at least one pitch angle of the head, the upper and lower arms can cooperate to simultaneously support a lacrosse ball throughout a first range of roll angles of the head and the adjacent side surface can support a lacrosse ball throughout a second range of roll angles of the head.

In one aspect, the size of the first range of roll angles can be at least approximately 60 degrees and the size of the second range of roll angles can be at least approximately 30 degrees.

In one aspect, the at least one pitch angle can include a range of pitch angles. The size of the range of pitch angles can be at least approximately 30 degrees.

In one aspect, the upper and lower arms can include bases and rails extending in a direction outward from the bases and substantially perpendicular to the bases, in which the upper and lower arms, the bases, and the rails are sized, shaped, and positioned for stably supporting a lacrosse ball along the rails throughout the portion of the length.

In one aspect, the head can include a longitudinal axis, and the at least one of the sidewalls can include a convex shape with respect to the longitudinal axis.

In one aspect, the head can include a longitudinal axis and at least one of the side surfaces of the throat can include a convex shape with respect to the longitudinal axis.

In one aspect, the throat can include an upper surface having a concave depression therein. The concave depression can have a size and a shape substantially similar to the size and the shape of at least a portion of a lacrosse ball for stably supporting a lacrosse ball therein.

In one aspect, the transverse wall can include an upper edge, a lower edge positioned to be adjacent a pocket disposed on the head, and one or more projections extending downward from the lower edge in a direction away from the upper edge towards a surface and being sized, shaped, and positioned for grabbing a lacrosse ball from the surface between the one or more projections and a pocket disposed on the head. The one or more projections can be separated by a width less than a diameter of a lacrosse ball and can include one or more of: substantially polygonal shapes, substantially oval shapes, and substantially semi-oval shapes.

In one aspect, the head can be integrally formed from molded plastic.

In one embodiment, a lacrosse-stick head can include a throat, a transverse wall, and two sidewalls extending outward from the throat and connected by the transverse wall. The throat includes two side surfaces. At least one of the sidewalls and an adjacent side surface of the throat form a groove sized, shaped, and positioned for stably rolling a ball throughout at least a portion of the length of the at least one of the sidewalls and onto the adjacent side surface. The portion of the length includes more than one half the length. The ball can include one or more of a baseball, a golf ball, a lacrosse ball, a rubber ball, a round rock, a softball, and a tennis ball.

These and other features of the described lacrosse-stick heads can be more fully understood by referring to the following detailed description and accompanying drawings. The drawings are not drawn to scale, but show only relative dimensions.

DETAILED DESCRIPTION

Figure 1:
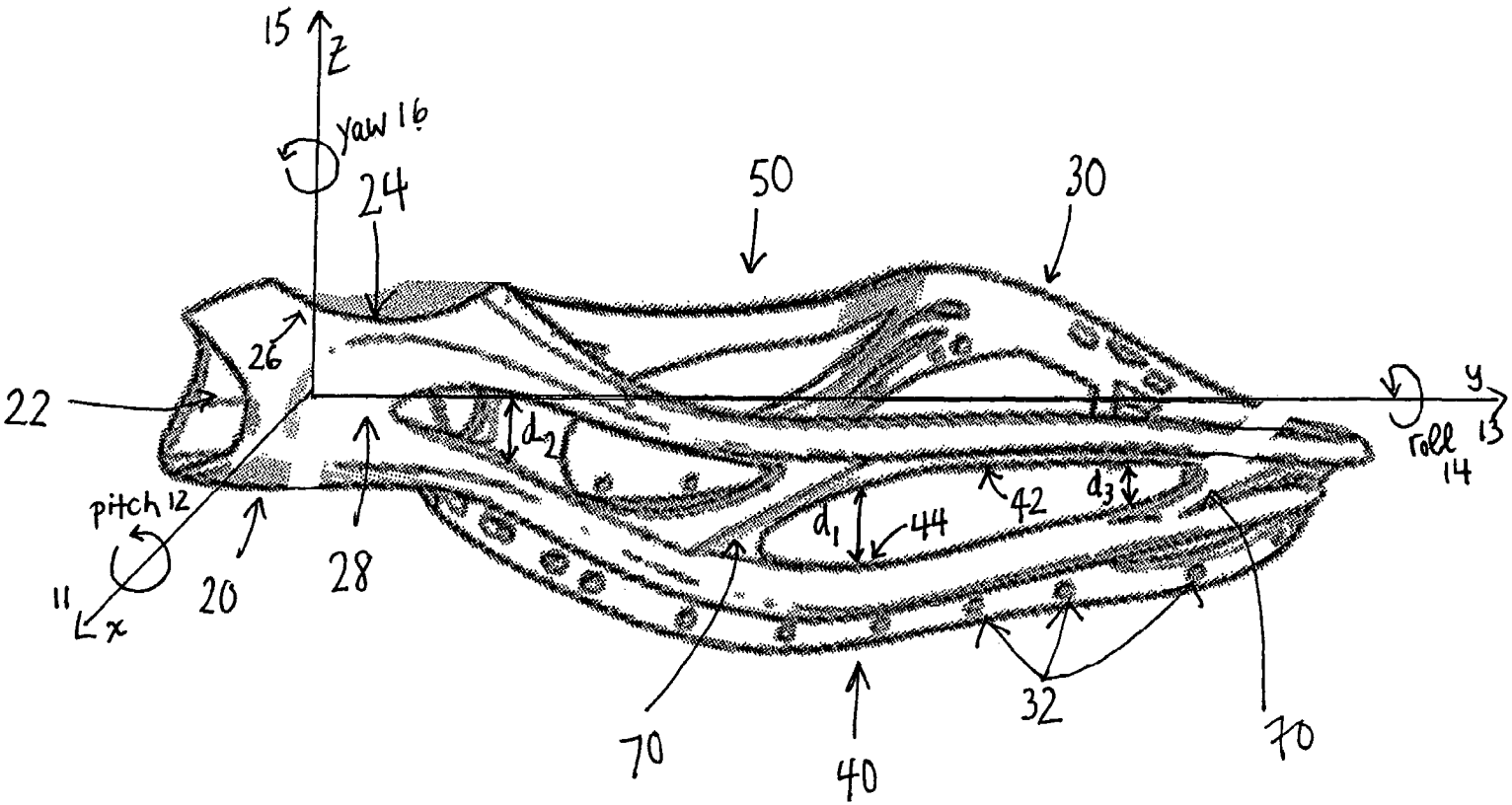
FIG. 1 is a perspective view of an exemplary lacrosse-stick head.

Illustrative embodiments will now be described to provide an overall understanding of the described lacrosse-stick heads. One or more examples of the embodiments are shown in the drawings. Those of ordinary skill in the art will understand that the described lacrosse-stick heads can be adapted and modified to provide devices for other applications, and that other additions and modifications can be made to the described lacrosse-stick heads without departing from the scope of the present disclosure. For example, aspects, components, and/or features, of the embodiments can be combined, separated, interchanged, and/or rearranged to generate other embodiments. Such modifications and variations are intended to be included within the scope of the present disclosure.

Figure 2:
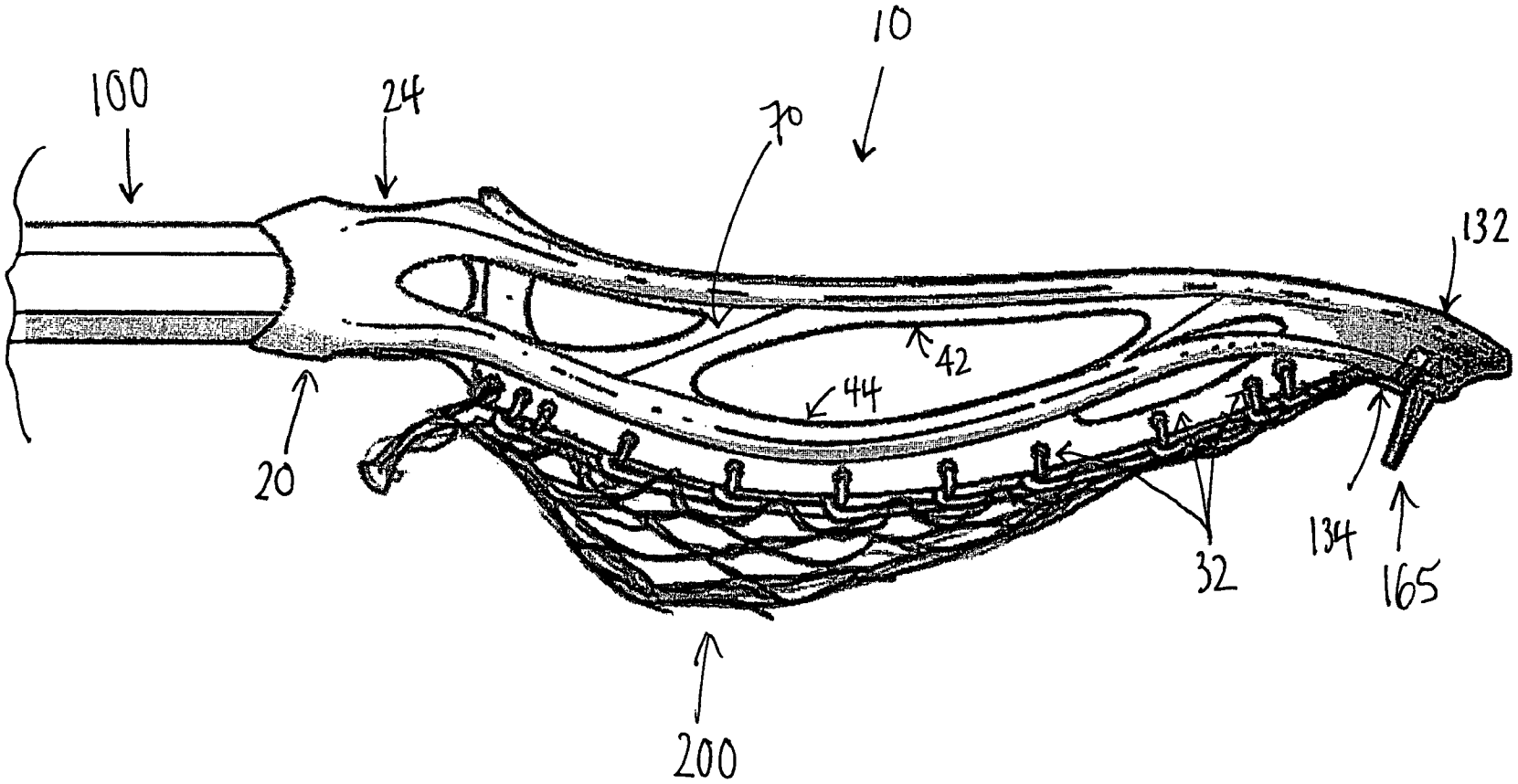
FIG. 2 is a perspective view of a lacrosse stick including the exemplary head shown in FIG. 1.

FIG. 1 shows an exemplary lacrosse-stick head, and FIG. 2 shows a lacrosse stick including the exemplary lacrosse-stick head. As shown in FIG. 1, the exemplary lacrosse-stick head 10 includes a throat 20 and two sidewalls 40 and 50 extending outward from the throat and connected by a transverse wall 30. The sidewall 40 extends outward from a side surface 28 of the throat 20. One or both of the sidewalls 40 and 50 can include spaced-apart upper and lower arms, such as upper and lower arms 42 and 44 of the sidewall 40. The upper and lower arms 42 and 44 can form the extreme extents of the sidewall 40. As shown in FIG. 2, the head 10 can be attached to a lacrosse-stick handle 100 and a lacrosse-stick pocket 200 for receiving a lacrosse ball.

As shown in FIG. 1, the orientation of the head 10 can be described with pitch, roll, and yaw angles 12, 14, and 16 with respect to a coordinate system having mutually orthogonal x, y, and z axes 11, 13, and 15. The roll angle 14 refers to rotation about the longitudinal axis of the head 10, i.e. about the y axis 13, and the pitch and yaw angles 12 and 16 refer to rotations about the x and z axes 11 and 15. FIGS. 1 and 2 show an orientation of the head 10 in which the pitch, roll, and yaw angles 12, 14, and 16 are zero, and FIG. 3 shows an orientation of the head 10 in which the pitch and yaw angles 12 and 16 are zero and the roll angle is approximately 90 degrees.

Figure 3:
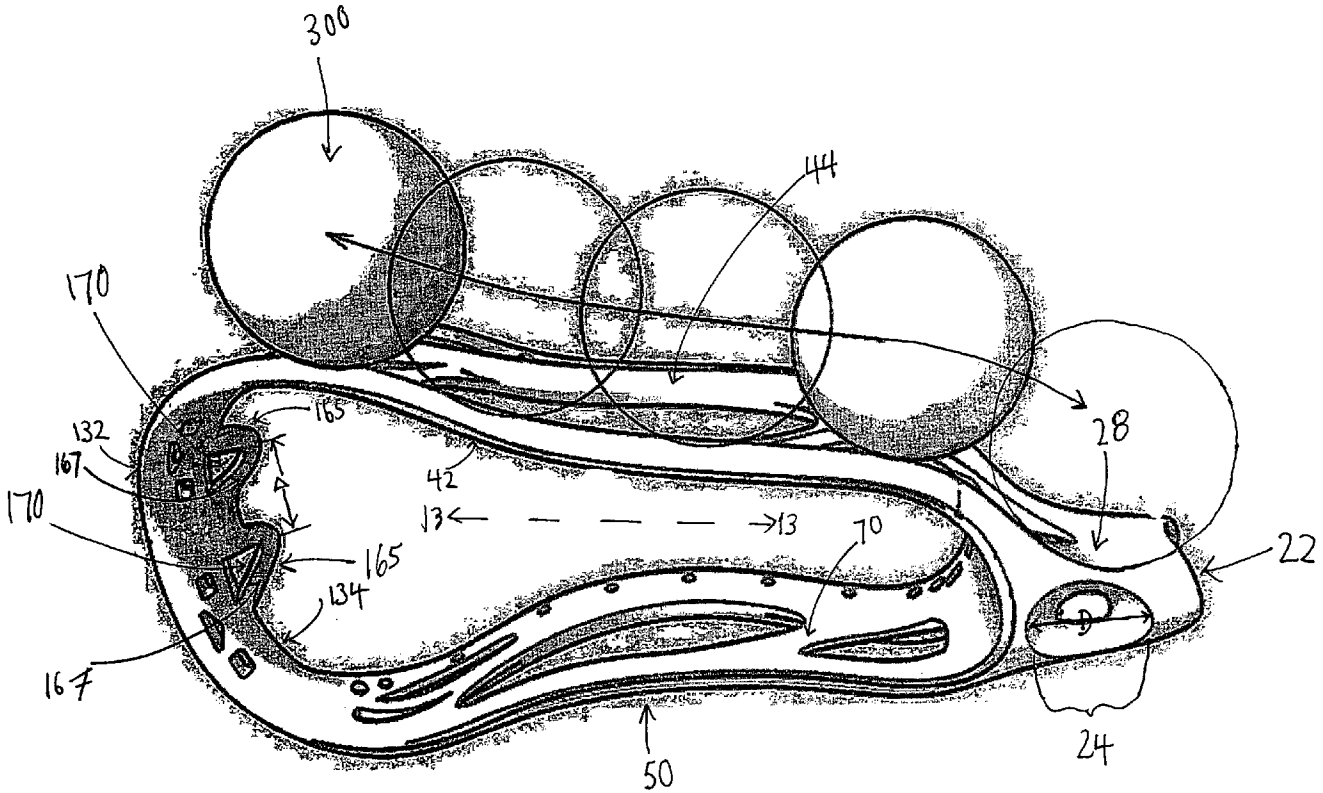
FIGS. 3 and 4 illustrate stable rolling of a lacrosse ball along a sidewall and onto a throat of the exemplary head shown in FIG. 1.
Figure 4:
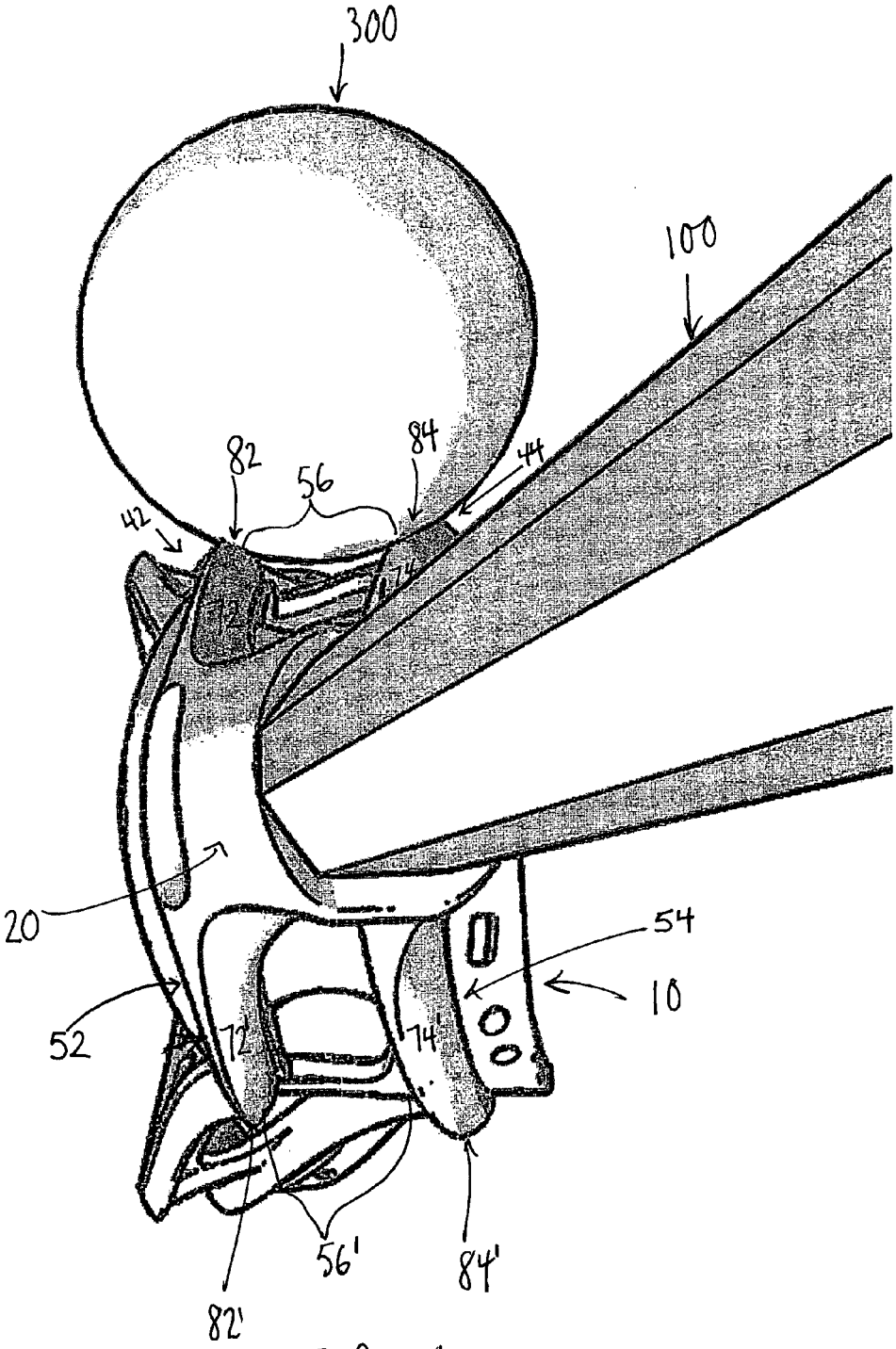

FIGS. 3 and 4 illustrate features of the head shown in FIG. 1. As shown in FIGS. 3 and 4, the sidewall 40 (e.g., the upper and lower arms 42 and 44) and the side surface 28 of the throat 20 are sized, shaped, and positioned for stably rolling a lacrosse ball 300 along at least a portion of the length of the sidewall 40 and onto the side surface 28. The term "stably" as used herein can be understood to mean that the sidewall 40 and the side surface 28 are sized, shaped, and positioned to form a rolling path extending from the sidewall 40 to the side surface 28 for at least one pitch angle 12 of the head 10 in which the force of gravity restores a lacrosse ball to the rolling path if the lacrosse ball is displaced from the rolling path within a range of roll angles 14 of the head 10. The sidewall 40 and the side surface 28 can be sized, shaped, and positioned to form such rolling paths throughout a range of pitch angles 12 of the head 10. For example, in the embodiments shown in FIGS. 3 and 4, the sidewall 40 and the side surface 28 can form rolling paths for pitch angles 12 ranging from about −30 degrees to about 30 degrees and roll angles 14 ranging from about 60 degrees to about 120 degrees. Other embodiments can exhibit ranges of pitch and roll angles 12, 14 that are smaller than the ranges just described. Preferably, however, the size of the range of roll angles 14 should be at least approximately 30 degrees, and the size of the range of pitch angles 12 should be at least approximately 30 degrees to facilitate control of a lacrosse ball.

The range of pitch 12 and roll 14 angles of the head 10 for which the sidewall 40 and the side surface 28 can form the previously described rolling paths represents a relationship between the sidewall 40 and the side surface 28. As will be understood by those of ordinary skill in the art, the sidewall 40 and, separately, the side surface 28 can support a lacrosse ball over ranges of pitch and/or roll angles that can be different than those describing the rolling paths.

As shown in FIGS. 3 and 4, in one embodiment, the upper and lower arms 42 and 44 of the sidewall 40 can be sized, shaped, and positioned such that, for at least one pitch angle 12 of the head 10, the upper and lower arms 42 and 44 cooperate to simultaneously support a lacrosse ball throughout a range of roll angles 14 of the head. The upper and lower arms 42 and 44 can cooperate to simultaneously support a lacrosse ball throughout a range of such pitch angles 12. For example, in the embodiments shown in FIGS. 3 and 4, the upper and lower arms 42 and 44 can cooperate to simultaneously support a lacrosse ball for pitch angles 12 ranging from about −30 degrees to 30 degrees and roll angles 14 ranging from about 45 degrees to about 135 degrees. Other embodiments can exhibit ranges of pitch and roll angles 12, 14 that are smaller than the ranges just described.

Figure 5:
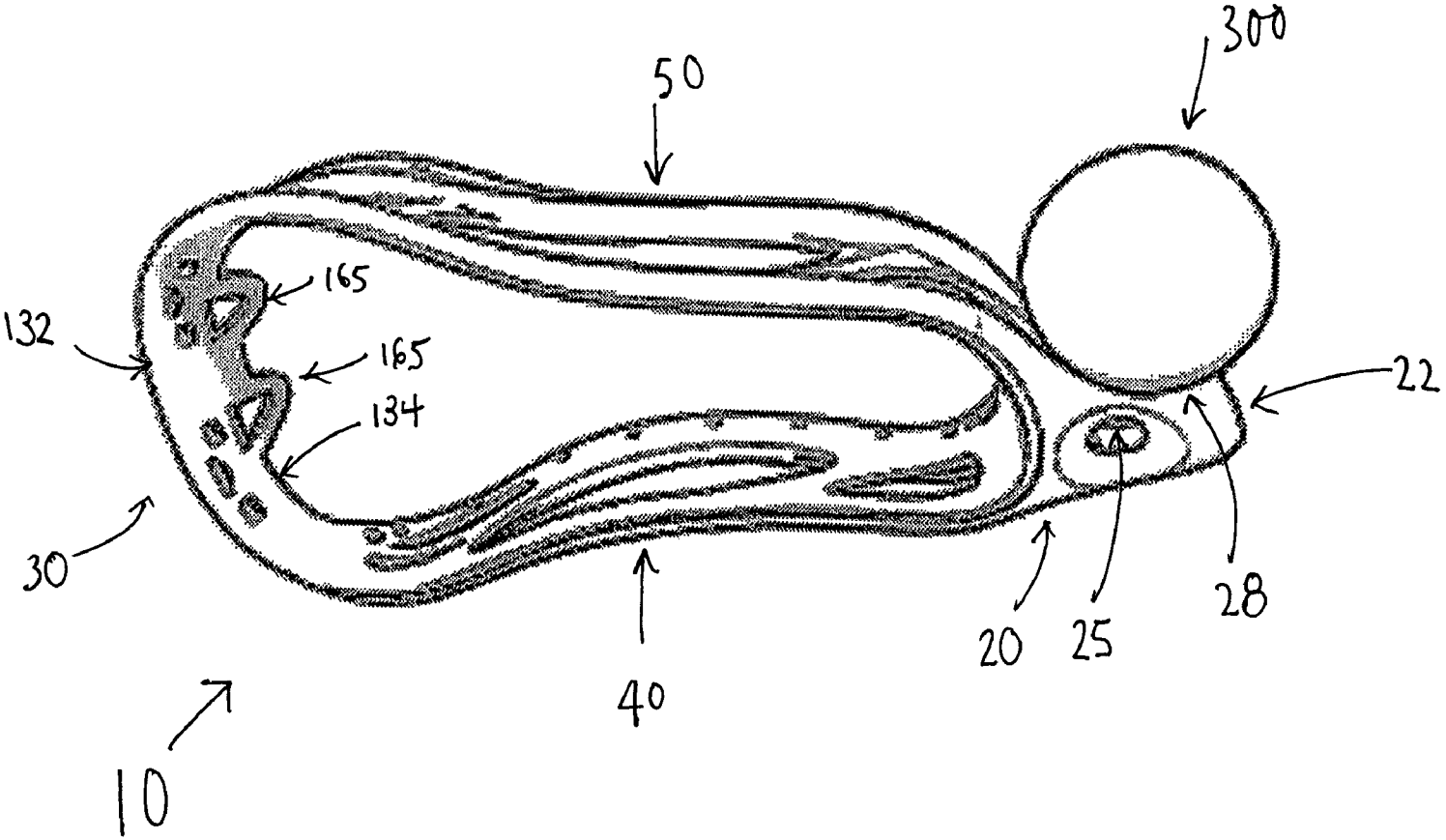
FIG. 5 illustrates balancing of a lacrosse ball on a throat of the exemplary head shown in FIG. 1.

As shown in FIGS. 3 and 5, the side surface 28 of the throat 20 can be sized, shaped, and positioned such that, for at least one pitch angle 12 of the head 10, the side surface 28 supports a lacrosse ball throughout a range of roll angles 14 of the head 10. The side surface 28 can support a lacrosse ball throughout a range of such pitch angles 12. For example, in the embodiments shown in FIGS. 3 and 4, the side surface 28 can support a lacrosse ball for pitch angles 12 ranging from about −30 degrees to about 30 degrees and roll angles 14 ranging from about 60 degrees to about 120 degrees. Other embodiments can exhibit ranges of pitch and roll angles 12, 14 that are smaller than the ranges just described.

As shown in FIG. 3, one or both of the sidewalls 40 and 50 includes a convex shape with respect to the longitudinal axis 13. For example, as shown in FIG. 3, the sidewall 40 curves inward towards the longitudinal axis 13.

As shown in FIGS. 1, 3, and 5, the side surface 28 of the throat 20 has a size and a shape substantially similar to the size and the shape of a portion of the lacrosse ball 300. The side surface 28 can include a convex shape with respect to the longitudinal axis 12, i.e., the side surface 28 can curve inward towards the longitudinal axis 13.

As shown in FIG. 1, the upper and lower arms 42 and 44 can be connected by one or more connecting portions 70. The connecting portions 70 can be sized, shaped, and positioned so as to not inhibit the upper and lower arms 42 and 44 from stably rolling a lacrosse ball along at least a portion of the length of the sidewall 40. For example, as shown in FIG. 3, the connecting portions 70 and the upper and lower arms 42 and 44 can be sized, shaped, and positioned for stably rolling a lacrosse ball 300 along the upper and lower arms 42 and 44 along substantially the entire length of the sidewall 40 without contacting the connecting portions 70. Also for example, as shown in FIG. 3, the connecting portions 70, the upper and lower arms 42 and 44, and the side surface 28 of the throat 20 can be sized, shaped, and positioned for stably rolling a lacrosse ball 300 along the upper and lower arms 42 and 44 along a portion of the length of the sidewall 40 and onto the side surface 28 without contacting the connecting portions.

As previously described, the sidewall 40, e.g., the upper and lower arms 42 and 44, is configured for stably rolling a lacrosse ball along at least a portion of the length of the sidewall 40. The portion can include at least one half of the length of the sidewall 40. The length of the sidewall can be measured from substantially the throat 20, e.g. the location near the throat 20 at which separate upper and lower arms 42 and 44 are first distinguishable, to substantially the transverse wall 30, e.g., to the location near the transverse wall 30 at which separate upper and lower arms 42 and 44 are last distinguishable. Other embodiments can exhibit portions that include larger lengths. For example, in some embodiments, the portion of the length can include substantially the entire length of the sidewall 40, i.e., the length of the sidewall 40 extending substantially from the throat 20 to substantially the transverse wall 30. Preferably, however, the portion of the length should be at least one half of the length of the sidewall 40 to facilitate control of a lacrosse ball.

As shown in FIG. 1, the upper and lower arms 42 and 44 are separated by a distance $d_i$. In some embodiments, such as the embodiment of FIG. 1, the distance $d_i$ can vary over the length of the sidewall 40 and/or over the portion of the length of the sidewall 40 configured for stably supporting the lacrosse ball 300. As shown in the embodiment of FIG. 1, the upper and lower arms 42 and 44 are separated by a distance $d_1$ near the middle of the sidewall 40 and by smaller distances $d_2$ and $d_3$ near the throat 20 and the transverse wall 30. Generally, the distance $d_i$ is less than the diameter of a lacrosse ball 300. The distance $d_i$ can range from approximately zero in some units, i.e., the distance at which separate upper and lower arms 42, 44 are first distinguishable, to nearly the diameter of a lacrosse ball 300.

As shown in FIG. 4, the pairs of upper and lower arms 42, 44 and 52, 54 can include bases 72, 74 and 72', 74' and rails 82, 84 and 82', 84' that extend in a direction substantially outward from and substantially perpendicular to the bases 72, 74 and 72', 74'. The rails 82, 84 and 82', 84' can form grooves 56, 56' for stably supporting the lacrosse ball 300. As shown in FIG. 4, the rails 82, 84 can include sufficient outward extents from the bases 72, 74 such that the lacrosse ball 300 can be stably rolled along the rails 82, 84 along a portion of the length of the sidewall 40, 50 without otherwise contacting portions of the sidewall 40, such as the connecting portions 70 shown in FIG. 1 and/or a lacrosse pocket disposed on the head 10, such as the lacrosse pocket 200 shown in FIG. 2.

As shown in FIGS. 1, 2, 3, and 5, the throat 20 can include a depression 24 in an upper surface 26 of the throat 20. The depression 24 is sized, shaped, and positioned for stably supporting the lacrosse ball 300. For example, in some embodiments, the depression 24 can be substantially concave in shape with respect to the upper surface 26, i.e., can curve inwards from the upper surface 26 towards an interior of the throat 20. The size and shape of the depression 24 is substantially similar to the size and the shape of a portion of the lacrosse ball 300, such that the lacrosse ball 300 can be stably supported on the depression 24. The depression 24 includes a diameter D that is less than or substantially equal to the diameter of the lacrosse ball 300. The depression 24 can include one or more cutouts 25 in the upper surface 26 of the throat 20.

Figure 6:
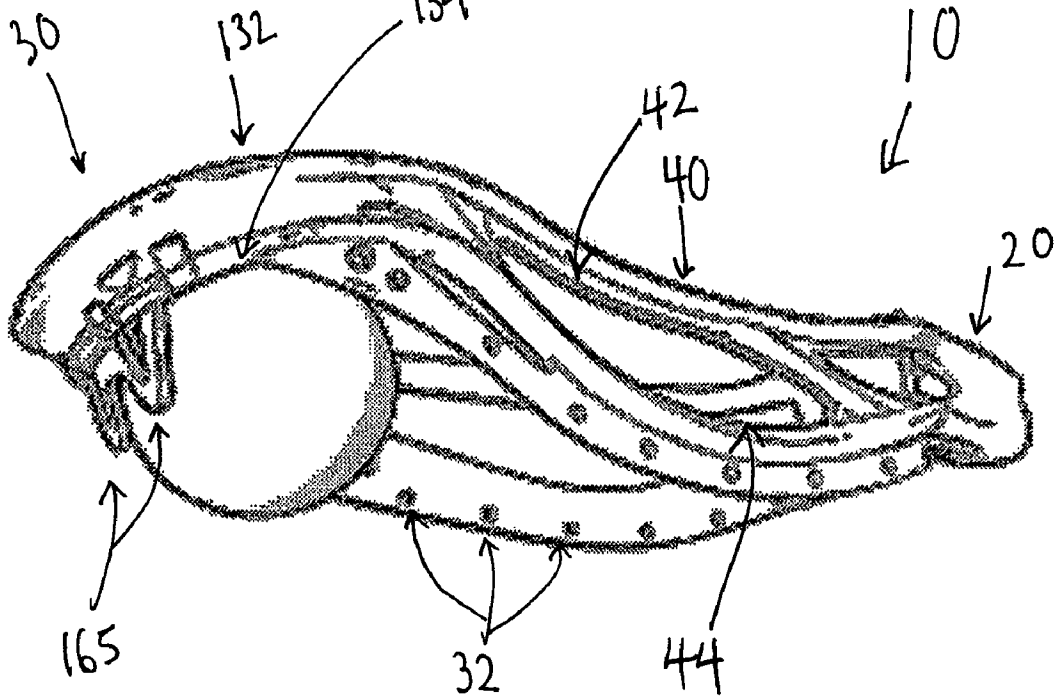
FIGS. 6 and 7 illustrate grabbing of a lacrosse ball from a surface with projections on a transverse wall of the exemplary head shown in FIG. 1.
Figure 7:
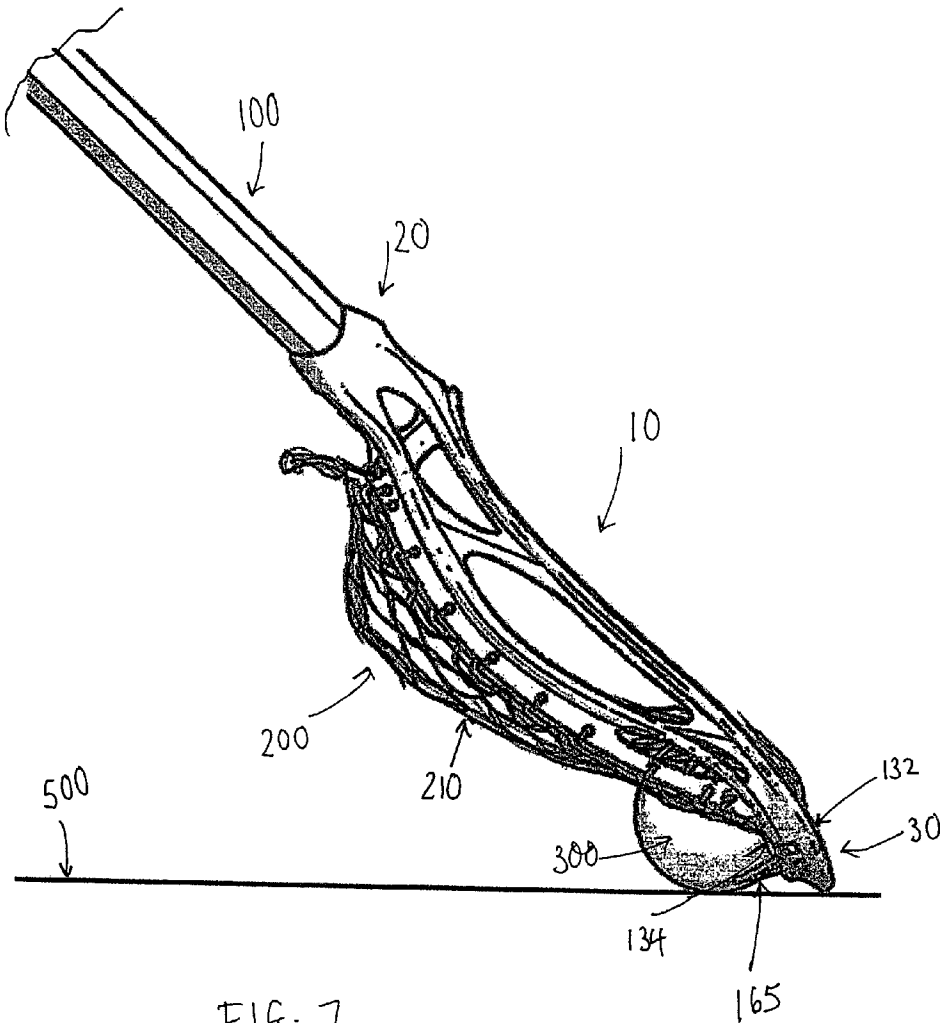

FIGS. 5-7 show features of the lacrosse-stick head 10 shown in FIG. 1. As shown in FIGS. 5-7, the transverse wall 30 of the head 10 can include an upper edge 132, a lower edge 134 positioned to be adjacent a pocket 200 disposed on the head 10 (i.e., the lower edge 134 is positioned to be closer to the pocket 200 than the upper edge 132 for an orientation of the head 10 having pitch and roll angles 12 and 14 of zero), and one or more projections 165 that extend downward from the lower edge 134 in a direction away from the upper edge 132 towards a surface 500. The projections 165 are sized, shaped, and positioned for grabbing the lacrosse ball 300 from the surface 500 between the projections 165 and a pocket 200 disposed on the head 100. For example, as shown in FIG. 7, the projections 165 are sized, shaped, and positioned for grabbing the lacrosse ball between the projections 165 and a surface 210 of the pocket 200 that faces the surface 500. The interior surfaces 167 of the projections 165, i.e. the surfaces of the projections 165 facing a pocket 200, can together form a shape that is similar to a shape of a portion of a lacrosse ball 300.

The projections 165 can include a variety of shapes. For example, as shown in FIGS. 5-7, the projections 165 include substantially triangular shapes. Alternatively, the projections 165 can include substantially polygonal shapes (e.g. shapes having three or more sides), substantially oval shapes (e.g. circular and elliptical shapes), and/or substantially semi-oval shapes (e.g. semi-circular and semi-elliptical shapes).

As shown in FIG. 3, the projections 165 are separated by a distance Δ. Generally, the distance Δ is less than the diameter of the lacrosse ball 300. The projections 165 can extend substantially perpendicular to the lower edge 134 of the transverse wall and can include sufficient outward extents from the lower edge 134 to facilitate grabbing of the lacrosse ball 300. As shown in FIG. 3, one or more cutouts 170 can be made in the transverse wall 30 to form the projections 165.

In some embodiments, the head 10 can include one projection 165. In one such embodiment, the projection 165 can include a width (i.e. an extent in a direction perpendicular to the outward extent) ranging from approximately 10% of the diameter of the lacrosse ball 300.

In some embodiments, the head 10 can include three or more projections 165. In one such embodiment, the outermost of the projections 165 (i.e. the two projections that are adjacent only one other projection) can be separated by a distance □ ranging up to nearly 100% of the diameter of the lacrosse ball 300.

The lacrosse-stick heads described herein can be fabricated based on schemes known to those of ordinary skill in the art. The heads can be fabricated from one or more of a ceramic, a metal, a plastic (e.g. nylon and/or polypropylene), and a wood. In some embodiments, the components of the heads can be formed from similar or different materials. In some embodiments, the heads can be integrally formed from a single material. For example, the heads can be constructed from molded plastic, such as injection molded plastic.

As shown in FIG. 2, the head 10 can be coupled to a lacrosse-stick handle 100. In some embodiments, the head 10 can be formed separately from the handle 100 and can be attached to or otherwise disposed on the handle 100 based on schemes known to those of ordinary skill in the art. For example, as shown in the embodiments of FIGS. 1 and 2, the head 10 can include a handle-receiving aperture 22 that can extend through at least a portion of the throat 20 for inserting the head 10 onto the handle 100. The head 10 can be glued, molded, press-fit, or otherwise attached to the handle 100. Alternatively, the head 10 can be formed integrally with the handle 100 based on schemes known to those of ordinary skill in the art.

As shown in FIG. 2, the head 10 can be attached to a lacrosse-stick pocket 200. In some embodiments, the head 10 can include one or more pocket apertures 32 that can be disposed in one or more of the throat 20, the transverse wall 30, and the sidewalls 40, 50 for attaching the pocket 200 to the head 100. The pocket apertures 32 can be sized, shaped, and arranged to facilitate attachment of the pocket 200. The pocket 200 can include pockets known to those of ordinary skill in the art, such as, but not limited to, pockets formed from one or more of leather and string.

As will be understood by those of ordinary skill in the art, the diameter of the lacrosse ball 300 can vary based on prevailing sporting regulations (e.g., regulations for novices, recreational players, secondary school players, collegiate players, and professionals). As used herein, the term "lacrosse ball" includes balls that are suitable for playing lacrosse under prevailing sporting regulations.

As will be understood by those of ordinary skill in the art, the described lacrosse-stick heads are not limited to use with lacrosse balls. For example, the upper and lower arms 42, 44 can form a groove 56 in which the groove 56 and an adjacent side surface 28 of the throat 20 are sized, shaped, and positioned for stably rolling a ball along at least a portion of the length of the sidewall 40 and onto the adjacent side surface 28. Also for example, the one or more projections 165 can be sized, shaped, and positioned for grabbing a ball from a surface 500. The ball can include one or more of a lacrosse ball, a tennis ball, a baseball, a softball, a golf ball, a rubber ball, a round rock, and other balls.

Those of ordinary skill in the art will recognize or be able to ascertain many equivalents to the exemplary embodiments described herein by using no more than routine experimentation. Such equivalents are encompassed by the scope of the present disclosure and the appended claims. Accordingly, the appended claims are not to be limited to the embodiments described herein, can include practices other than those described, and are to be interpreted as broadly as allowed under prevailing law.

The invention claimed is:

1. A lacrosse-stick head comprising:

an open frame including a throat, a pair of sidewalls, and a transverse wall connecting said throat to each one of said pair of sidewalls;

said throat including two outer side surfaces, said throat intended to communicate with a lacrosse handle, said each one of said pair of sidewalls having an inner surface and an outer surface as defined by a center line of said lacrosse handle, said outer surface of one of said pair of sidewalls and a respective outer side surface of said throat defining an outer surface structure, said outer surface structure extending outward from a respective one of said two outer side surfaces of the throat and said one of said pair of sidewalls and connected by said transverse wall, wherein said outer surface structure is sized, shaped, and positioned for stably rolling a lacrosse ball along at least half of its length; wherein said one of said pair of sidewalls includes upper and lower arms and, for at least one pitch angle of the head, the upper and lower arms cooperate to simultaneously support a lacrosse ball throughout a first range of roll angles of the open frame and the adjacent outer side surface of the throat supports a lacrosse ball throughout a second range of roll angles of the open frame.

2. The head of claim 1, wherein the upper and lower arms, the at least one connecting portion, and the adjacent outer side surface of the throat are sized, shaped, and positioned for stably rolling a lacrosse ball along the upper and lower arms throughout a portion of their length and onto the adjacent outer side surface without contacting the at least one connection portion.

3. The head of claim 1, wherein the upper and lower arms and the at least one connecting portion are sized, shaped, and positioned for stably rolling a lacrosse ball along the upper and lower arms along substantially their entire length without contacting the at least one connecting portion.

4. The head of claim 1, wherein along at least half of its length includes substantially its entire length.

5. The head of claim 1, wherein the size of the first range of roll angles is at least approximately 60 degrees, and the size of the second range of roll angles is at least approximately 30 degrees.

6. The head of claim 1, wherein the upper and lower arms cooperate to simultaneously support a lacrosse ball over a range of pitch angles.

7. The head of claim 6, wherein the size of the range of pitch angles is approximately 30 degrees.

8. The head of claim 1, wherein said one of said pair of sidewalls includes upper and lower arms and the upper and lower arms include bases and rails extending in a direction outward from the bases and substantially perpendicular to the bases, the upper and lower arms, the bases, and the rails being sized, shaped, and positioned for stably supporting a lacrosse ball along the rails throughout a portion of their length.

9. The head of claim 1, wherein the open frame includes a longitudinal axis and said one of said pair of sidewalls includes a convex shape with respect to the longitudinal axis.

10. The head of claim 1, wherein said open frame includes a longitudinal axis and at least one of said two outer side surfaces of said throat includes a convex shape with respect to said longitudinal axis.

11. The head of claim 1, wherein said throat includes an outer upper surface having a concave depression therein, said concave depression having a size and a shape substantially similar to the size and the shape of at least a portion of a lacrosse ball for stably supporting a lacrosse ball therein.

12. The head of claim 1, wherein said transverse wall includes an upper edge, a lower edge positioned to be adjacent a pocket disposed on said open frame, and one or more projections extending downward from said lower edge in a direction away from said upper edge and being sized, shaped, and positioned for grabbing a lacrosse ball from a surface, the lacrosse ball being positioned between said one or more projections and said pocket disposed on said open frame upon being grabbed from said surface.

13. The head of claim 12, wherein said one or more projections are separated by a width less than a diameter of a lacrosse ball.

14. The head of claim 13, wherein cross-sectional shapes of said one or more projections include one or more of: polygonal shapes, oval shapes, and semi-oval shapes.

15. The head of claim 1, wherein said open frame is integrally formed from molded plastic.

16. A lacrosse-stick head comprising:

an open frame including a throat, a pair of sidewalls, and a transverse wall connecting said throat to each one of said pair of sidewalls;

said throat including two outer side surfaces, said throat intended to communicate with a lacrosse handle, said each one of said pair of sidewalls having an inner surface and an outer surface as defined by a center line of said lacrosse handle, said outer surface of one of said pair of sidewalls and a respective outer side surface of said throat defining an outer surface structure, said outer surface structure extending outward from a respective one of said two outer side surfaces of the throat and said one of said pair of sidewalls and connected by said transverse wall, said outer surface structure of said one of said pair of sidewalls and an adjacent outer side surface of the throat forming a groove therewithin, said groove being sized, shaped, and positioned for stably rolling a ball along at least half of its length; wherein said one of sidewalls includes upper and lower arms and, for at least one pitch angle of the head, the upper and lower arms cooperate to simultaneously support a lacrosse ball throughout a first range of roll angles of the open frame and and the adjacent outer side surface of the throat supports a lacrosse ball throughout a second range of roll angles of the open frame.

17. The head of claim 16, wherein the ball includes one or more of a baseball, a golf ball, a lacrosse ball, a rubber ball, a spherical object ranging in size from a golf ball to a softball, a softball, and a tennis ball.

18. The head of claim 16, wherein said upper and lower arms and said at least one connecting portion are sized, shaped, and positioned for stably rolling said ball along said upper and lower arms throughout a portion of their length and onto said respective adjacent outer side surface of said throat without contacting the at least one connecting portion.

19. The head of claim 16, wherein said upper and lower arms and said at least one connecting portion are sized, shaped, and positioned for stably rolling said ball along said upper and lower arms along substantially their entire length and onto said respective adjacent outer side surface of said throat without contacting the at least one connecting portion.

20. The head of claim 16, wherein along at least half of its length includes substantially its entire length.

21. A lacrosse-stick head comprising:

an open frame including a throat, a pair of sidewalls, and a transverse wall connecting said throat to each one of said pair of sidewalls;

said throat including two outer side surfaces, said throat intended to communicate with a lacrosse handle, a transverse wall, the transverse wall including an upper edge, a lower edge positioned to be adjacent a pocket disposed on the open frame, and one or more projections extending downward from the lower edge in a direction away from the upper edge and being sized, shaped, and positioned for grabbing a lacrosse ball from a surface such that the lacrosse ball is positioned between the one or more projections and the pocket disposed on the open frame, and each of said pair of sidewalls having an inner surface and an outer surface as defined by a center line of said lacrosse handle, said outer surface of one of said pair of sidewalls and a respective outer side surface of said throat defining an outer surface structure, said outer surface structure extending outward from a respective one of outer side surfaces of the throat and said one of said pair of sidewalls and connected by the transverse wall; wherein said one of said pair of sidewalls includes upper and lower arms and, for at least one pitch angle of the head, the upper and lower arms cooperate to simultaneously support a lacrosse ball throughout a first range of roll angles of the open frame and the adjacent outer side surface of the throat supports a lacrosse ball throughout a second range of roll angles of the open frame.

22. The head of claim 21, wherein said one or more projections are separated by a width less than a diameter of said lacrosse ball.

23. The head of claim 21, wherein cross-sectional shapes of said one or more projections include one or more of: polygonal shapes, oval shapes, and semi-oval shapes.

24. The head of claim 21, wherein said open frame is integrally formed from molded plastic.

* * * * *